US006533196B1

(12) United States Patent
Ouin et al.

(10) Patent No.: US 6,533,196 B1
(45) Date of Patent: Mar. 18, 2003

(54) PUMP OR VALVE DISPENSING HEAD

(75) Inventors: Christian Ouin, Villez sur le Neubourg (FR); Olivier de Pous, Paris (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/601,504

(22) PCT Filed: Jan. 29, 1999

(86) PCT No.: PCT/FR99/00178

§ 371 (c)(1),
(2), (4) Date: Feb. 13, 2001

(87) PCT Pub. No.: WO99/39992

PCT Pub. Date: Aug. 12, 1999

(30) Foreign Application Priority Data

Feb. 3, 1998 (FR) ..... 98 012160

(51) Int. Cl.[7] ..... B05B 1/34
(52) U.S. Cl. ..... 239/476; 239/491
(58) Field of Search ..... 239/337, 373, 239/463, 490–492, 519, 397, 442; 222/402.1, 402.13

(56) References Cited

U.S. PATENT DOCUMENTS 3,703,994 A 11/1972 Nigro
5,593,094 A * 1/1997 Barriac et al. ..... 239/476
5,676,311 A 10/1997 Hartman

FOREIGN PATENT DOCUMENTS

FR 1482900 9/1967

* cited by examiner

*Primary Examiner*—Lisa A. Douglas
(74) *Attorney, Agent, or Firm*—Sughrue Mion, PLLC

(57) ABSTRACT

A dispenser head (1) designed to be mounted on the plunger stem of a dispenser, such as a pump or a valve, for dispensing a fluid substance, the dispenser head (1) includes a body (2) provided with a recess (21) serving to receive the plunger stem, and with at least one duct (22) causing the recess (21) to communicate with a dispenser orifice (45; 35), the dispenser head being characterized in that the body (2) is received securely in an over-cap (3) which covers it while leaving the recess (21) unobstructed.

29 Claims, 2 Drawing Sheets

PUMP OR VALVE DISPENSING HEAD

The present invention relates to a dispenser head designed to be mounted on the plunger stem of a dispenser device, such as a pump or a valve, for dispensing a fluid substance. The dispenser head serves as an actuating member on which action is taken by means of a finger for the purpose of actuating the pump or the valve. The fluid substance is delivered from the pump or from the valve through the plunger stem on which the spray head is mounted. In order to enable the fluid to be dispensed, the dispenser head is provided with a dispensing orifice which communicates with the plunger stem via an outlet duct. When a liquid such as a perfume is to be dispensed, the dispenser head can incorporate a spray jet-forming insert making it possible to spray the liquid.

A conventional spray head is shown in FIG. 1 and is designated by the overall numerical reference 10. The head 10 comprises a body 2 which is cylindrical in shape. At its top end, the body 2 forms a wall 27 against which a finger is pressed to actuate the pump or the valve. In addition, the body 2 defines a peripheral skirt 28 which extends downwards from said wall 27 over a certain height. The height of the peripheral skirt 28 is determined in part by the height of the stroke of the plunger stem of the pump or valve on which the head is mounted. For reasons of aesthetic appearance, the skirt 28 must extend to the level of the fixing ring for fixing the pump or the valve to the container, in order to hide the plunger stem. Thus, when the pump or valve is actuated, the peripheral skirt 28 of the dispenser head 10 engages above the fixing ring. The height of the peripheral ring 28 is thus directly dependent on the type of pump or valve on which the spray head 10 is mounted.

In addition, the body 2 is provided with a recess 21 serving to receive the top end of the plunger stem. The recess 21 communicates with one or more outlet ducts 22. The one or more ducts 22 open out in an annular space formed around a core 23 that is formed integrally in the body 2. The recess thus formed by the annular space serves to receive a spray jet-forming insert 4 which is engaged by force in said annular space. Conventionally, the insert 4 is provided with a dispensing orifice, and when a fluid substance such as perfume is to be dispensed, the insert 4 can further be provided with spray means such as a swirl chamber connected via tangential swirl channels connecting to the duct 22.

In short, a conventional dispenser head is provided with a recess for receiving the plunger stem, with an outlet orifice connecting to said recess, with a push surface against which a finger is pressed, and with a peripheral skirt for masking the plunger stem.

That type of dispenser head is, in general, made of molded plastic. The mold necessary for manufacturing such a dispenser head essentially comprises three parts, namely a bottom core which defines the inside of the dispenser head and in particular the recess for receiving the plunger stem, a top shell which defines the outside portion of the head, and in particular the push surface and the outside wall of the peripheral skirt, and a pin that can be inserted through the top shell to define the annular space for receiving the insert and the duct 22 that causes the recess to communicate with the insert. The pin is inserted horizontally through the top shell while the join plane of the mold is defined at the bottom end of the peripheral skirt 28. It can thus be understood that it is not possible to vary the height of the peripheral skirt 28 since the distance between the join plane and the pin forming the annular space is fixed. Therefore, it is necessary to use a plurality of molds to manufacture dispenser heads having peripheral skirts of different heights for hiding the plunger stem, which gives rise to much higher investment cost.

An object of the present invention is to mitigate that problem of the prior art by defining a dispenser head in which the height of the peripheral skirt can be varied, without using a different mold for forming the body of the head.

In addition, since the dispenser head is made of a plastics material, shrinkage or sinking occurs locally, thereby locally affecting the visible surfaces of the head because of the unequal thicknesses in the plastics part. In particular, sink marks are often visible at the push top face of the head in the zone corresponding to the recess and to the duct. Such marks adversely affects the aesthetic appearance of the dispenser head. Another object of the present invention is thus to mitigate the visible effects of such sinking.

In addition, it is sometimes a requirement for the color of the dispenser head to match the color of fixing ring or of the container. In which case, it is necessary to color to the plastics material of which the dispenser head is made. Since the colorants used for tinting the plastics material are costly products, the cost of a colored dispenser head is also high. An object of the present invention is also to make it possible for colored dispenser heads to be made at lower cost.

To this end, the present invention provides a dispenser head designed to be mounted on the plunger stem of a dispenser device, such as a pump or a valve, for dispensing a fluid substance, said spray head comprising a body provided with a recess serving to receive the plunger stem, and with at least one duct causing said recess to communicate with a dispenser orifice, the body being received securely in an over-cap which covers it while leaving the recess unobstructed. The over-cap may be made of metal, but it is preferably made of a plastics material, and it solves all of the problems of the prior art related to the height of the peripheral skirt, to shrinkage, and to the color of the head. As regards the height of the peripheral skirt, it is easier and less costly to vary the height of the over-cap than to vary the height of the body of the head because the mold necessary to make the over-cap is much simpler. The body of the head thus becomes a standard element for a given head diameter, independently of the height of the head. A single body mold suffices for a head of a given diameter.

As regards shrinkage, it does not take place in an over-cap made of a plastics material given that the thickness of the wall thereof is uniform.

Finally, as regards the color of the head, given that the quantity of plastic necessary for molding the over-cap is less than the quantity necessary for molding a conventional body, a smaller quantity of colorant is necessary.

The Document FR-1 482 900 admittedly describes a pusher provided with a cover that covers internal members of the pusher defining a valve member. The cover is thus mounted to slide axially on the cap. The element making it possible to hold the cover on the cap is the insert which projects from the skirt of the cover. For this purpose, given that the cover is mounted to move relative to the insert, the opening through which the insert projects is overdimensioned to enable the cover to slide. In that plunger, the cover serves merely as an actuating wall for actuating the valve member so as to hold it closed until the pressure is released. The sliding characteristic is thus essential to the operation of that pusher.

Although that document describes a cover, it is not used for the same purposes, and, in addition, it is slidably mounted.

Depending on the embodiment, the dispensing orifice is formed by a spray jet-forming insert mounted on the body, the over-cap being provided with an opening for enabling the insert to pass through on mounting it on the body. In a variant, the dispensing orifice is formed in the over-cap.

In both cases, the head may include spray means in the form of a swirl chamber centered on the dispensing orifice and fed via at least two tangential swirl channels connecting to said at least one duct. In which case, the swirl chamber and the channels may be formed in the insert. In a variant, the swirl chamber and the channels may be formed in the body.

When the dispensing orifice is formed in the over-cap, and the swirl chamber and the swirl channels are formed in the body, it is not necessary to use a separate insert mounted on the body. A saving of one part and therefore of one corresponding mold is thus achieved. The over-cap then performs an additional function, namely the function of dispensing orifice.

In another embodiment, the body and the over-cap are provided with angular positioning means for determining the angular positioning of the over-cap relative to the body while they are being assembled, so that the spray orifice is centered on assembly relative to the swirl chamber. Advantageously, the inside of the over-cap forms an angular positioning and penetrating spike co-operating with a set-back of corresponding shape provided in the body. The angular position of the over-cap on the body is thus set automatically on assembly.

The invention is described more fully below with reference to the accompanying drawings giving two embodiments of the present invention by way of non-limiting example.

Figure 2:
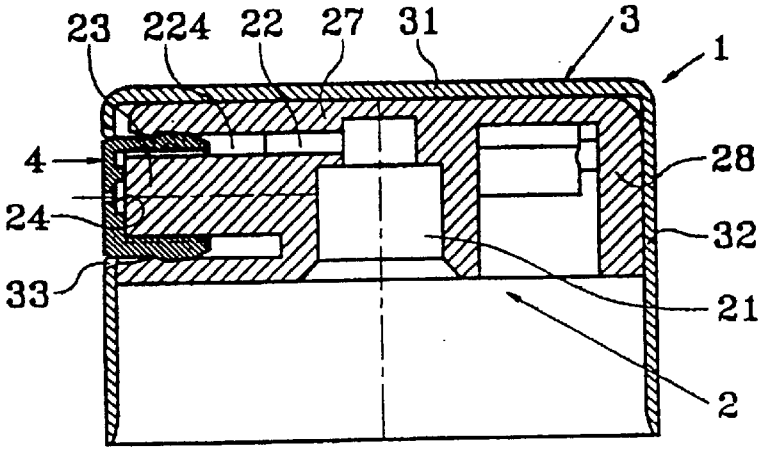
FIG. 2 is a cross-section view through a dispenser head in a first embodiment of the present invention.
Figure 3:
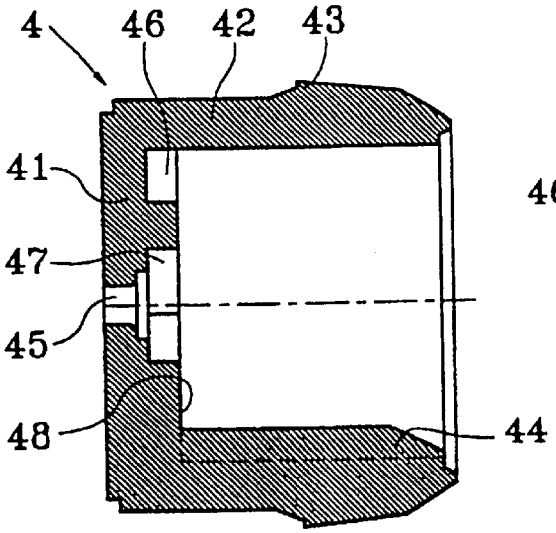
FIG. 3 is a cross-section view of the insert used in the dispenser head of FIG. 2.
Figure 4:
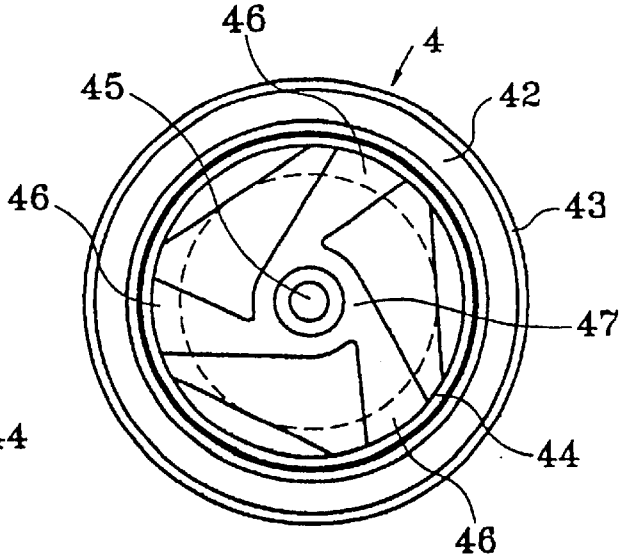
FIG. 4 is a plan view of the inside of the insert of FIG. 3.

In a first embodiment shown in FIGS. 2 to 4, the dispenser head 1 of the present invention comprises three component parts, namely a body 2, an over-cap 3, and an insert 4. These three elements are preferably made of a molded plastics material, although the over-cap 3 may also be made of metal. For example, the body 2 may be made of molded polypropylene, and the over-cap 3 and the insert may be made of a harder plastic, e.g. an acetal.

Figure 1:
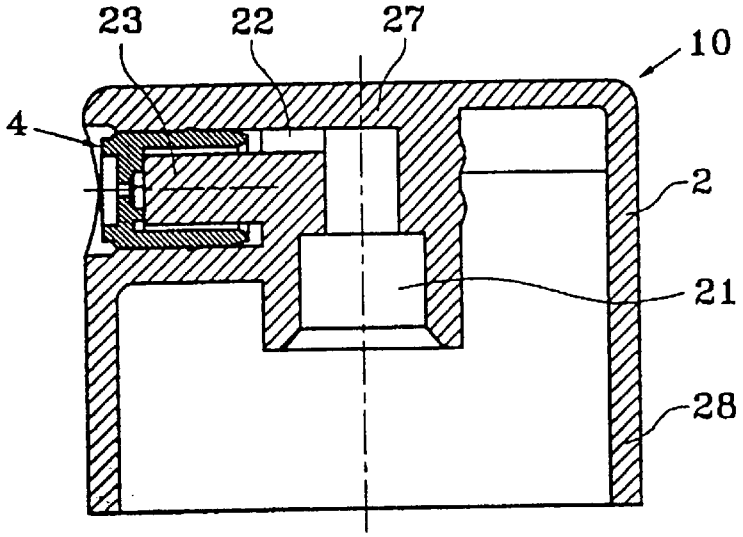
Prior Art FIG. 1
FIG. 1 is a cross-section view of a prior art dispenser head.

With reference more precisely to FIG. 2, the body 2 is of a conventional design quite similar to the design of the prior art spray head shown in FIG. 1. Therefore, the body 2 forms an axial central recess 21 for receiving the top end of the plunger stem of the pump or of the valve on which the head 1 is mounted. The recess 21 communicates via an outlet channel 22 with an annular space 224 defined around a core 23 having an annular end surface 24 that is accurately plane. As shown in FIG. 2, the space 224 serves to receive a spray jet-forming insert 4 by snap-fastening. The insert is described in detail below with reference to FIG. 3. In addition, the body 2 forms an annular top surface 27 and a peripheral flange 28 which extends downwards over the entire periphery of the body 2. At the annular recess 224 for receiving the insert 4, the annular flange 28 is provided with a hole. The essential difference with the body of a conventional dispenser head lies in the length of the peripheral skirt which, in this example, is reduced to a peripheral flange 28.

FIGS. 3 and 4 show, on a larger scale, the insert 4 used in the spray head 1 shown in FIG. 2. The insert 4 is a conventional insert in the form of a small cup whose end wall 41 is provided with a dispensing orifice 45. This dispensing orifice 45 communicates with a setback 47 which co-operates with the flat annular end surface 24 of the core 23 to form a swirl chamber 47. The end wall 41 is further provided with three other setbacks 46 as shown in FIG. 4, which setbacks cause the swirl chamber 47 to communicate with the inside periphery of the insert 4. These setbacks 46 co-operate with the plane annular surface 24 of the core 23 to form three swirl channels 46 that connect to the swirl chamber 47 tangentially so as to cause the fluid substance to flow in a swirling motion in the chamber 47. In order to cause the annular space 224 to communicate with the swirl channels 46, the inside cylindrical wall 42 of the insert 4 is provided with grooves 44. Thus, the fluid substance delivered through the plunger stem can flow through the duct 22 into the annular space 224, and through the grooves 44 and the swirl channels 46 to the swirl chamber 47 where it is finally dispensed through the dispensing orifice 45 towards the outside in the form of a jet of sprayed substance. Good isolation of the swirl channels 46 and of the swirl chamber 47 is possible by using plastics materials of different hardnesses: e.g. the insert may be made of acetal, while the body 2 is made of polypropylene, so that the insert 4 deforms the plane end surface 24 of the core 23 slightly, thereby providing good leaktightness. For fixing the insert 4 to the core 23, the cylindrical wall 42 of the insert is provided with snap-fastening catches 43 which co-operate with the body 2 by material interference because of the difference in hardness of the plastics used to make them. The insert is thus put in place stably and securely on the body.

In the invention, the body 2 is covered with the over-cap 3 which covers the top end surface 27 and the peripheral flange 28 while leaving the recess 21 unobstructed. It is preferable for the inside wall 3 of the over-cap 3 to match the shape of the body 2 at its peripheral flange 28 and at its top surface 27 as can be seen in FIG. 2. It is thus important for the inside sides of the over-cap to correspond accurately to the outside sides of the body 2. It is thus possible to engage the body 2 under force into the over-cap without it being necessary to use other means for locking the body 2 inside the over-cap 3. The body 2 is thus received and held securely in the over-cap 3. As can be seen in FIG. 2, the over-cap is in the form of a single cylindrical cup with an end-wall defining the push top annular surface 31 against which action is taken by means of a finger, and a peripheral wall defining a peripheral skirt 32 which performs the same function as the prior art peripheral skirt shown in FIG. 1. The over-cap 3 has a wall-thickness that is accurately uniform so that no shrinkage affects it. It may also be made using a colored plastics material.

In this embodiment, the peripheral skirt 32 of the over-cap 3 is provided with an opening 33 serving to enable the insert 4 to be passed through on being mounted on the body 2. During the operation of mounting this dispenser head, it is firstly necessary to engage the body 2 into the over-cap 3, and then to put the insert 4 in place on the core 23 of the body 2. As a result, the over-cap must be provided with an opening enabling said insert 4 to pass through. It should be noted that the dispenser head of the invention may be mounted using a conventional machine once the body has been engaged in the over-cap.

It is easy to understand that it is easy to cause the height of the dispenser head 1 to vary by using an over-cap of different height. It is thus not necessary to modify the body 2 which in no way determines the height of the head. As a result of its simplicity, the over-cap 3 is easy to make at lower cost with different heights. In addition, since the body 2 is no longer a visible element, it is of little importance whether it is affected by aesthetic defects such as sink marks.

Figure 5:
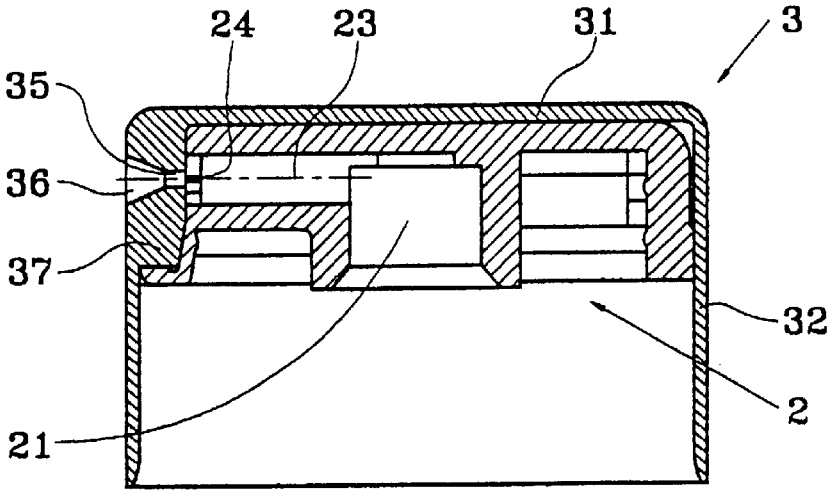
FIG. 5 is a cross-section view of a dispenser head in a second embodiment of the present invention
Figure 6:
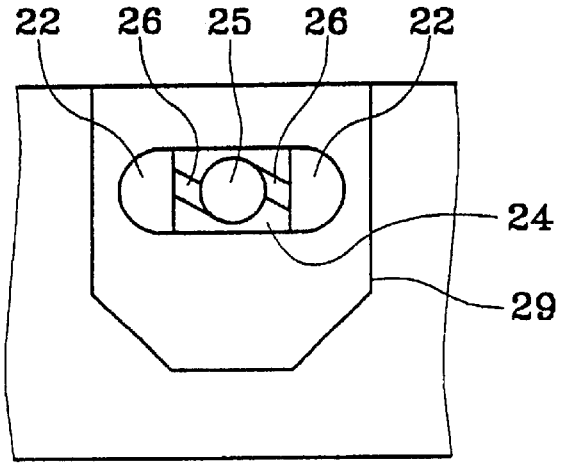
FIG. 6 is a plan view of the portion of the body of the dispenser head that forms the spray means.
Figure 7:
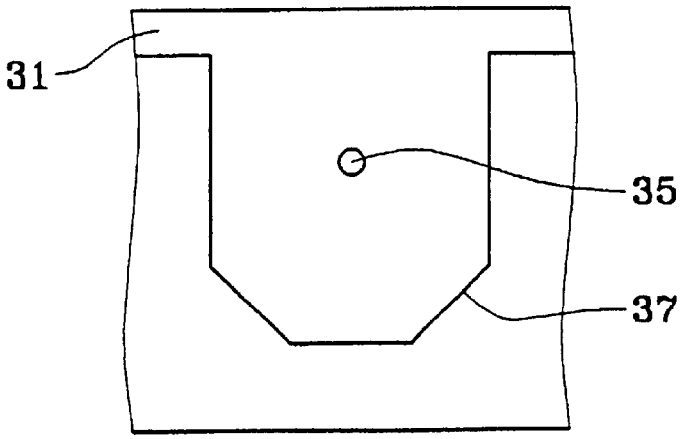
FIG. 7 is a plan view of the inside of the over-cap at the dispensing orifice.

Reference is made to FIGS. 5 to 7 to describe a particularly advantageous second embodiment. The advantage of this spray head lies in the fact that it is made up of two elements only, namely the body 2 and the over-cap 3. The function of the insert is performed in this example by the body 2 and by the over-cap 3 in association. As can be seen in FIG. 6, the swirl chamber 25 and the swirl channels 26 are formed in the end surface 24 of the core 23 formed by the body 2. The example shown is a particular embodiment implementing two swirl channels 26 connected to respective ones of two symmetrical side channels 22 which open out in the recess 21. This configuration makes it possible for the swirl channels 26 to be fed entirely symmetrically. Whereas conventionally the chamber 25 and the channels 26 are formed in the separate insert, in this embodiment the chamber and the channels are formed directly in the body 2. Symmetrically, the wall used to isolate the channels 26 from each other and to complete the chamber 25 is formed by the over-cap 3. As can be seen in FIGS. 5 and 7, this closure wall must be provided with a dispensing orifice 35 which causes the swirl chamber 25 to communicate with the outside. Advantageously, the over-cap 3 may form a directional spray cone 36 downstream from the spray orifice 35.

It should also be noted that this embodiment makes it possible to reduce considerably the height of the insert, and therefore the total height of the head.

In this embodiment, it is essential for the dispensing hold 35 to be accurately centered relative to the swirl chamber 25. For this purpose, angular positioning means are provided, making it possible to determine accurately the angular positioning of the over-cap 3 relative to the body 2. In an embodiment, the angular positioning means are in the form of an angular positioning and penetrating spike 37 which co-operates with a setback 29 of corresponding shape provided in the body 2. As shown in FIGS. 5 and 7, this spike may be provided at the spray orifice 35. This spike 37 is in the form of an extra-thickness of wall provided at the peripheral skirt 32. This spike 37 defines a downward-facing tip which serves to co-operate with the setback 29 formed in the body 2 and which ha a corresponding shape. As shown in FIG. 6, the core 23 with its end surface 24 in which the chamber 25 and the channels 26 are formed is situated at said setback 29. By means of the co-operation between the spike 37 and the setback 29, accurate angular positioning is thus guaranteed, and therefore the dispensing orifice is centered 35 relative to the swirl chamber 25.

Although not shown and more complicated to achieve, it is also possible to form the swirl chamber and the swirl channels in the over-cap. The body then has a core whose end surface is accurately plane, as in the first embodiment.

By means of the over-cap, it is possible to cause the height of the spray head to vary at lower cost, and to improve the aesthetic appearance of the head while eliminating any problems related to shrinkage and while reducing the costs related to coloring the plastic.

What is claimed is:

1. A dispenser head (1) designed to be mounted on a plunger stem of a dispenser device for dispensing a fluid substance, said dispenser head (1) comprising a body (2) having a peripheral flange, the body provided with a recess (21) serving to receive the plunger stem, and with at least one duct (22) causing said recess (21) to communicate with a dispenser orifice (45; 35), said dispenser head being characterized in that the body (2) is received in an over-cap (3) which covers the body while leaving the recess (21) unobstructed; and wherein the over-cap has a peripheral skirt that extends axially beyond the peripheral flange of the body.

2. A spray head according to claim 1, in which the over-cap (3) is made of metal.

3. A spray head according to claim 1, in which the over-cap (3) is made of plastic.

4. A spray head according to claim 1, in which the dispensing orifice (45) is formed by a spray jet-forming insert (4) mounted on the body (2), said over-cap (3) being provided with an opening (33) for enabling the insert (4) to pass through on mounting it on the body (2).

5. A spray head according claim 1, in which said dispensing orifice (35) is formed in the over-cap (3).

6. A spray head according to claim 1, including spray means (46, 47; 25, 26) in the form of a swirl chamber (47; 25) centered on the dispensing orifice (45; 35) and fed via at least two tangential swirl channels (46; 26) connecting to said at least one duct (22).

7. A spray head according to claim 1, wherein the dispensing orifice is formed by an insert and a swirl chamber having swirl channels, and in which the swirl chamber (47) and the channels (46) are formed in the insert (4).

8. A spray head according to claim 1, in which the swirl chamber (25) and the channels (26) are formed in the body (2).

9. A dispenser head designed to be mounted on a plunger stem of a dispenser device for dispensing a fluid substance, said dispenser head comprising a body provided with a recess serving to receive the plunger stem, and with at least one duct causing said recess to communicate with a dispenser orifice, said dispenser head being characterized in that the body is axially engaged under force into and received securely in an over-cap which covers it while leaving the recess unobstructed; and in which the body (2) and the over-cap (3) are provided with angular positioning means (29, 37) for determining the angular positioning of the over-cap (3) relative to the body (2) while they are being assembled.

10. A spray head according to claim 9, in which the inside of the over-cap (3) forms an angular positioning and penetrating spike (37) co-operating with a setback (29) of corresponding shape provided in the body (2).

11. A dispenser head comprising a body forming a peripheral flange and at least one outlet duct exiting on the exterior of said flange, characterized in that the peripheral flange is surrounded by an over-cap matching the shape of the peripheral flange, the over-cap and the flange forming together spraying means in the form of a swirl chamber centered on a dispensing orifice and fed through at least two tangential swirl channels connecting to said at least one duct; and wherein the over-cap has a peripheral skirt that extends axially beyond the peripheral flange of the body.

12. A dispenser head according to claim 11, wherein said flange forms said two swirl channels and said swirl chamber, the over-cap completing and isolating the swirl channels and completing the swirl chamber, the over-cap forming said dispensing orifice centered on the swirl chamber.

13. A dispenser head according to claim 11, wherein said the over-cap is made of metal.

14. A dispenser head according to claim 11, wherein said the over-cap is made of plastic.

15. A dispenser head comprising a body forming a peripheral flange and at least one outlet duct exiting on the exterior of said flange, characterized in that the peripheral flange is axially engaged under force into and surrounded by an over-cap matching the shape of the peripheral flange, the over-cap and the flange forming together spraying means in the form of a swirl chamber centered on a dispensing orifice and fed through at least two tangential swirl channels connecting to said at least one duct; and wherein said the body and the over-cap are provided with angular positioning means for determining the angular positioning of the over-cap relative to the body while they are being assembled.

16. A dispenser head according to claim 15, the inside of the over-cap forms angular positioning and penetrating spike co-operating with a setback of corresponding shape provided in the body.

17. A spray head according to claim 1, in which the over-cap is in the form of a cylindrical cup with an end-wall defining a push top annular surface and a peripheral wall defining a peripheral skirt.

18. A dispenser head according to claim 11, in which the over-cap is in the form of a cylindrical cup with an end-wall defining a push top annular surface and a peripheral wall defining a peripheral skirt.

19. The dispenser head according to claim 1, wherein the dispensing device is a pump or a valve.

20. A dispenser head mounted on a plunger stem of a dispenser device for dispensing a fluid substance, the dispenser head comprising:

a body comprising a recess in which a plunger stem is received, the body further comprising a top, a peripheral flange, and at least one duct that communicates the recess with a dispenser orifice; and an over-cap in the form of a cup defined by a bottom and a peripheral skirt;

wherein the body is axially engaged within the over-cap and forms a tight fit between the peripheral flange of the body and the peripheral skirt of the over-cap; and wherein an inside surface of the over-cap bottom abuts an inside surface of the top of the body, and wherein the peripheral skirt of the over-cap extends axially beyond the peripheral flange of the body.

21. A dispenser head designed to be mounted on a plunger stem of a dispenser device for dispensing a fluid substance, said dispenser head comprising a body provided with a recess serving to receive the plunger stem, and with at least one duct causing said recess to communicate with a dispenser orifice, said dispenser head being characterized in that the body is received securely in an over-cap which covers it while leaving the recess unobstructed, and in that the body and the over-cap are provided with angular positioning means for determining the angular positioning of the over-cap relative to the body while they are being assembled.

22. A dispenser head comprising a body forming a peripheral flange and at least one outlet duct exiting on the exterior of said flange, characterized in that the peripheral flange is surrounded by an over-cap matching the shape of the peripheral flange, the over-cap and the flange forming together spraying means in the form of a swirl chamber centered on dispensing orifice and fed through at least two tangential swirl channels connecting to said at least one duct, and in that the body and the over-cap are provided with angular positioning means for determining the angular positioning of the over-cap relative to the body while they are being assembled.

23. The dispenser head according to claim 1, wherein the body is axially engaged under force into and received securely in an over-cap.

24. The dispenser head according to claim 11, wherein the peripheral flange is axially engaged under force into and surrounded by the over-cap.

25. The dispenser head according to claim 1, wherein the over-cap is in the form of a cup.

26. The dispenser head according to claim 11, wherein the over-cap is in the form of a cup.

27. A dispenser head configured to be mounted on a plunger stem of a dispenser device for dispensing a fluid substance, the dispenser head comprising a body provided with a recess configured to receive the plunger stem, and with at least one duct causing the recess to communicate with a dispenser orifice; wherein the body is axially engaged under force into and received securely in an over-cap that covers the body while leaving the recess unobstructed; wherein the body has an outer wall surface and the over-cap has an interior wall surface; and wherein the body is fit within the over-cap by relatively sliding the interior wall surface on the outer wall surface along an axis of the body during the axial engagement of the body in the over-cap.

28. A dispenser head comprising a body forming a peripheral flange with an outer wall surface and at least one outlet duct exiting on the exterior of said flange, characterized in that the peripheral flange is surrounded by an over-cap matching the shape of the peripheral flange, the over-cap and the flange forming together spraying means in the form of a swirl chamber centered on a dispensing orifice and fed through at least two tangential swirl channels connecting to said at least one duct; wherein the over-cap has an interior wall surface; and wherein the body is fit within the over-cap by relatively sliding the interior wall surface on the outer wall surface along an axis of the body during the axial engagement of the body in the over-cap.

29. A dispenser head mounted on a plunger stem of a dispenser device for dispensing a fluid substance, the dispenser head comprising:

a body comprising a recess in which a plunger stem is received, the body further comprising a top, an outer surface, and at least one duct that communicates the recess with a dispenser orifice; and an over-cap in the form of a cup defined by a bottom and a peripheral skirt;

wherein the body is tightly fit within the over-cap by sliding the outer surface of the body relative to the over-cap along an actuating axis of the body until an inside surface of the over-cap bottom abuts an inside surface of the top of the body.

* * * * *